US012064814B2

(12) United States Patent
Sugio et al.

(10) Patent No.: US 12,064,814 B2
(45) Date of Patent: Aug. 20, 2024

(54) METHOD FOR MANUFACTURING αFe—SiC COMPOSITE MATERIAL, AND αFe—SiC COMPOSITE MATERIAL

(71) Applicants: HIROSHIMA UNIVERSITY, Hiroshima (JP); Y-tec Corporation, Hiroshima (JP); KEYLEX CORPORATION, Hiroshima (JP); Mazda Motor Corporation, Hiroshima (JP)

(72) Inventors: Kenjiro Sugio, Hiroshima (JP); Takuya Takahashi, Hiroshima (JP); Hitoshi Sawada, Hiroshima (JP); Gen Sasaki, Hiroshima (JP); Kazuhiro Matsugi, Hiroshima (JP); Yongbum Choi, Hiroshima (JP); Zhefeng Xu, Hiroshima (JP); Hajime Suetsugu, Hiroshima (JP); Hiroki Kondo, Hiroshima (JP); Hideki Manabe, Hiroshima (JP); Kyotaro Yamane, Hiroshima (JP); Kenichi Hatakeyama, Hiroshima (JP); Keizo Kawasaki, Hiroshima (JP); Tsuyoshi Itaoka, Hiroshima (JP); Shinsaku Seno, Hiroshima (JP); Yasushi Tamura, Tokyo (JP); Ichirou Ino, Hiroshima (JP); Yoshihide Hirao, Hiroshima (JP)

(73) Assignees: HIROSHIMA UNIVERSITY, Hiroshima (JP); Y-tec Corporation, Hiroshima (JP); KEYLEX CORPORATION, Hiroshima (JP); Mazda Motor Corporation, Hiroshima (JP)

( * ) Notice: Subject to any disclaimer, the term of this patent is extended or adjusted under 35 U.S.C. 154(b) by 548 days.

(21) Appl. No.: 17/266,371

(22) PCT Filed: Jul. 9, 2019

(86) PCT No.: PCT/JP2019/027083
§ 371 (c)(1),
(2) Date: Feb. 5, 2021

(87) PCT Pub. No.: WO2020/031585
PCT Pub. Date: Feb. 13, 2020

(65) Prior Publication Data
US 2021/0316361 A1 Oct. 14, 2021

(30) Foreign Application Priority Data
Aug. 7, 2018 (JP) ..... 2018-148884

(51) Int. Cl.
*B22F 3/105* (2006.01)
*C21D 6/00* (2006.01)
(Continued)

(52) U.S. Cl.
CPC ..... *B22F 3/105* (2013.01); *C21D 6/008* (2013.01); *C21D 7/13* (2013.01); *C22C 33/02* (2013.01);
(Continued)

(58) Field of Classification Search
CPC ..... B22F 2003/1051; B22F 2009/043; B22F 2998/10; B22F 2999/00; B22F 3/105;
(Continued)

(56) References Cited

U.S. PATENT DOCUMENTS

2004/0226403 A1* 11/2004 Narasimhan ..... C22C 33/0228 75/246
2011/0293461 A1 12/2011 Duz et al.

FOREIGN PATENT DOCUMENTS

CN 1566392 A 1/2005
CN 107385306 A 11/2017
(Continued)

OTHER PUBLICATIONS

CarTech 409Cb stainless. Carpenter Technology. May 1, 1996. (Year: 1996).*
(Continued)

*Primary Examiner* — Nicholas A Wang
(74) *Attorney, Agent, or Firm* — Casimir Jones, S.C.; Robert A. Goetz

(57) ABSTRACT

Provided is a method of producing a composite having high strength and high thermal conductivity. The method includes: an alloy preparation step including preparing an alloy which is a solid solution containing α-Fe as a solvent
(Continued)

and at least one type of α-phase stabilizing element as a solute; a first mixing step including mixing at least one type of α-phase stabilizing element in powder form and SiC to prepare a first mixture; a second mixing step including mixing the alloy and the first mixture to prepare a second mixture; and a sintering step including sintering the second mixture.

7 Claims, 4 Drawing Sheets

(51) Int. Cl.
*C21D 7/13* (2006.01)
*C22C 33/02* (2006.01)
*C22C 38/02* (2006.01)

(52) U.S. Cl.
CPC ..... *C22C 38/02* (2013.01); *C21D 2211/001* (2013.01)

(58) Field of Classification Search
CPC . B22F 3/14; B22F 5/007; B22F 9/082; C21D 2211/001; C21D 6/008; C21D 7/13; C22C 29/065; C22C 33/0292
See application file for complete search history.

(56) References Cited

FOREIGN PATENT DOCUMENTS

| | | |
|---|---|---|
| JP | 2015-168874 | 9/2015 |
| JP | 2018-053308 | 4/2018 |
| WO | WO 01/17717 A1 | 3/2001 |

OTHER PUBLICATIONS

Hu, Z. "Studies on sintering silicon carbide nanostructured ferritic alloy composites for nuclear applications." 2016. Virginia polytechnic institute and state university. p. 1-60. (Year: 2016).*

Nygren, M. et al. "Spark plasma sintering: Possibilities and limitations." 2004. Key engineering materials. 264-268. p. 719-724. (Year: 2004).*

Guillon, O et al. "Field-assisted sintering technology/spark plasma sintering: mechanisms, materials, and technology developments ." 2014. Advanced engineering materials. 16. p.830-849. (Year: 2014).*

Zhang, et al. "The sintering mechanism in spark plasma sintering—proof of the occurrence of spark discharge." 2014. Scripta materialia. 81. p. 56-59. (Year: 2014).*

Suryanarayana, C. "Mechanical alloying and milling". 2001. Progress in materials science. 46. p. 1-184. (Year: 2001).*

Joshua Pelleg, "Reaction in the matrix and interface of the Fe—SiC matal matrix composite system", Materials Science and Engineering, A269(1999), 225-241.

International Preliminary Report on Patentability for PCT/JP2019/027083, mailed Feb. 9, 2021, 5 pages.

International Search Report for PCT/JP2019/027083, mailed Sep. 17, 2019, 2 pages.

Mukherjee S K et al: "Sintered Ion-Ceramic Composites", Journal of Material Science, Kluwer Academic Publishers, Dordrecht, vol. 28 , No. 3 , Feb. 1, 1993 (Feb. 1, 1993), pp. 729-734, XP001106783, ISSN: 0022-2461, DOI: 10.1007/BF01151249.

Pelleg et al: "Reactions in the matrix and interface of the Fe—SiC metal matrix composite system", Materials Science, Elsevier, Amsterdam, NL, vol. 269, No. 1-2, Aug. 30, 1999 (Aug. 30, 1999), pp. 225-241, XP027362247, ISSN: 0921-5093 [retrieved on Aug. 30, 1999].

Hu Zhihao et al: "Studies on Sintering Silicon Carbide-Nanostructured Ferritic Alloy Composites for Nuclear Applications", Jul. 22, 2016 (Jul. 22, 2016), XP055924518, 68 pages, Retrieved from the Internet: URL:https://vtechworks.lib.vt.edu/bitstream/handle/10919/81763/Hu_Z_T_2016.pdf?sequence=1 [retrieved on May 24, 2022].

EESR for EP Patent Application No. 19847666.5, mailed Jun. 7, 2022, 11 pages.

TANG Wenming et al., "Interface Stability of the SiC Particles Fe Matrix Composite System", Journal of Wuhan University of Technology (Sep. 30, 2006), vol. 21, No. 3, pp. 49-53.

Office Action for CN Patent Application No. 201980052289.2, mailed Sep. 1, 2021, 10 pages.

* cited by examiner (a)

(b)

METHOD FOR MANUFACTURING αFe—SiC COMPOSITE MATERIAL, AND αFe—SiC COMPOSITE MATERIAL

TECHNICAL FIELD

The present invention relates to a method of producing an α-Fe—SiC composite and relates to an α-Fe—SiC composite.

BACKGROUND ART

In the production of automobiles etc., the weight of a vehicle's body has been reduced to improve fuel economy. For example, a material for parts has been upgraded to a super-high-tensile steel to reduce the weight of a vehicle's body. Because the material for parts has been upgraded to a super-high-tensile steel, hot press molding has been increasingly used because it makes it possible to achieve dimensional accuracy of molded parts and ensure strength of the parts. In view of such circumstances, there is a demand for an improvement in efficiency of hot press molding.

An improvement in efficiency of hot press molding can be achieved by, for example, improving the life of a mold for use in hot press molding or by reducing the time taken for a mold for use in hot press molding to cool. An improvement in the life of a mold for use in hot press molding can be achieved by employing a material having high hardness as the mold. On the other hand, a reduction in the time taken for a mold for use in hot press molding to cool can be achieved by employing a highly thermally conductive material as the mold. Nowadays, there is a demand for a material having high hardness and high thermal conductivity as a material for a mold for use in hot press molding in order to improve the efficiency of hot press molding. For example, Non-patent Literature 1 discusses, as a material having high hardness and high thermal conductivity, an α-Fe—SiC composite, which is a composite of α-Fe and SiC (silicon carbide).

CITATION LIST

Non-Patent Literature

[Non-patent Literature 1]

Joshua Pelleg, "Reaction in the matrix and interface of the Fe—SiC metal matrix composite system", Materiaks Science and Engineering A269 (1999) 225-241

SUMMARY OF INVENTION

Technical Problem

Non-patent Literature 1 discloses that, with regard to the α-Fe—SiC composite, SiC in α-Fe decomposes very easily in the austenitic temperature range, and indicates that the α-Fe—SiC composite is difficult to produce.

Solution to Problem

As a result of diligent research, the inventors of the present invention arrived at an α-Fe—SiC composite having both high strength and high thermal conductivity and a method of producing the α-Fe—SiC composite.

Specifically, in order to attain the above object, a method of producing an α-Fe—SiC composite in accordance with an aspect of the present invention includes: an alloy preparation step including preparing an alloy which is a solid solution containing α-Fe as a solvent and at least one type of α-phase stabilizing element as a solute; a first mixing step including mixing at least one type of α-phase stabilizing element in powder form and SiC to prepare a first mixture; a second mixing step including mixing the alloy and the first mixture to prepare a second mixture; and a sintering step including sintering the second mixture.

In order to attain the above object, a method of producing an α-Fe—SiC composite in accordance with an aspect of the present invention includes: an alloy preparation step including preparing an alloy which is a solid solution containing α-Fe as a solvent and at least one type of α-phase stabilizing element as a solute; a third mixing step including mixing the alloy and at least one type of α-phase stabilizing element in powder form to prepare a third mixture; a fourth mixing step including mixing the third mixture and SiC to prepare a fourth mixture; and a sintering step including sintering the fourth mixture.

In order to attain the above object, an α-Fe—SiC composite in accordance with an aspect of the present invention contains: an alloy which is a solid solution containing α-Fe as a solvent and at least one type of α-phase stabilizing element as a solute; and SiC, wherein a proportion by volume of the SiC to the alloy is not less than 1.0%, and the SiC has an average particle size of 1 μm to 100 μm.

Advantageous Effects of Invention

An aspect of the present invention makes it possible to provide an α-Fe—SiC composite having both high strength and high thermal conductivity.

Figure 2:
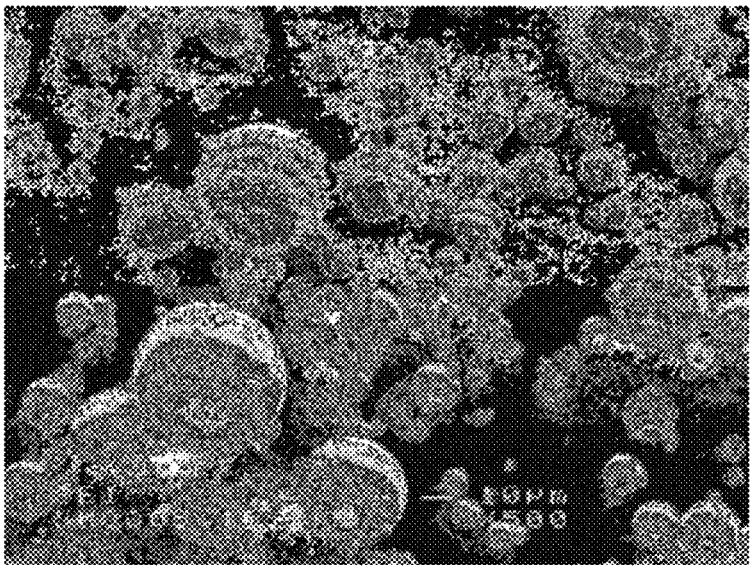
Figure 2:
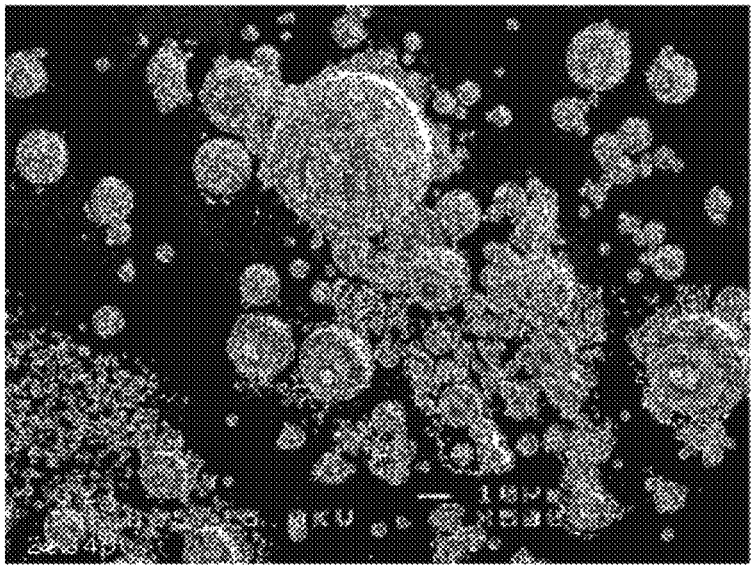

(a) of FIG. 2 is an SEM image of an alloy prepared by adding 2 at. % of an α-phase stabilizing element. (b) of FIG. 2 is an SEM image of an alloy prepared by adding a plurality of α-phase stabilizing elements in an amount of 12 at. % in total.

Figure 3:
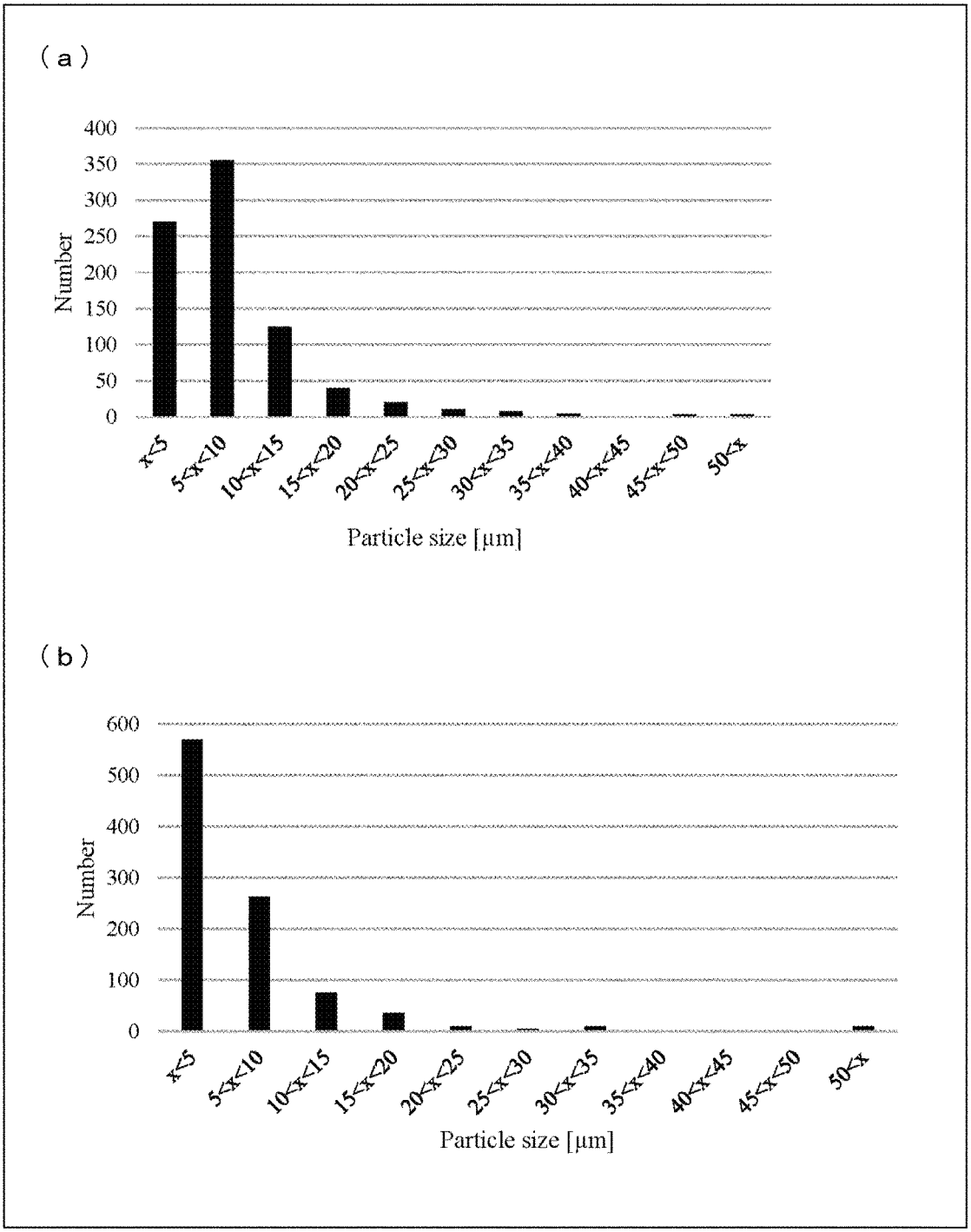

(a) of FIG. 3 is a chart showing the average particle size of an alloy prepared by adding 2 at. % of an α-phase stabilizing element. (b) of FIG. 3 is a chart showing the average particle size of an alloy prepared by adding a plurality of α-phase stabilizing elements in an amount of 12 at. % in total.

Figure 4:
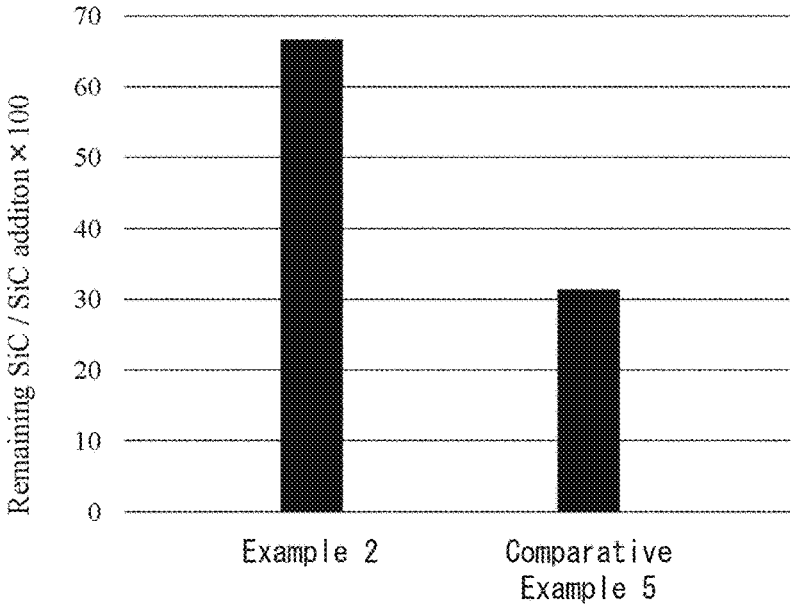

FIG. 4 is a chart showing the effects of a method of adding α-phase stabilizing element(s) on the percentage of remaining SiC.

Figure 5:
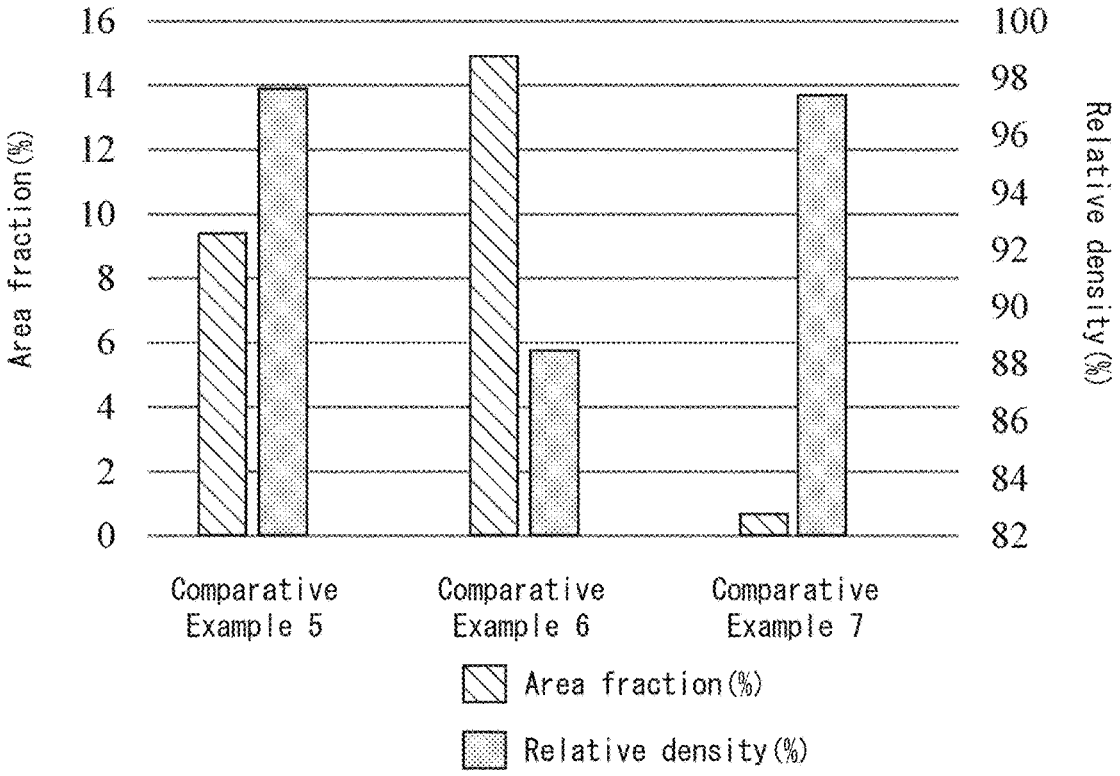

FIG. 5 is a chart showing the effects of sintering temperature and temperature maintenance time on the percentage of remaining SiC.

DESCRIPTION OF EMBODIMENTS

Embodiment 1

The following description will discuss embodiments of the present invention. The present invention is not, however, limited to these embodiments.

The present invention is not limited to the configurations described below, but may be altered in various ways within the scope of the claims. The present invention also encompasses, in its technical scope, any embodiment or example derived by combining technical means disclosed in differing embodiments and examples. Furthermore, all academic and patent documents cited in the present specification are incorporated herein by reference. Any numerical range expressed as "A to B" in the present specification means "not less than A and not more than B, unless otherwise stated.

The following description will discuss an α-Fe—SiC composite and a method of producing the α-Fe—SiC composite, in accordance with Embodiment 1. The α-Fe—SiC composite in accordance with Embodiment 1 has both high strength and high thermal conductivity, and can be suitably used as, for example, a material for a mold for use in, for example, hot press molding.

<1. Method of Producing α-Fe—SiC Composite>

A method of producing an α-Fe—SiC composite in accordance with Embodiment 1 includes an alloy preparation step, a first mixing step, a second mixing step, and a sintering step.

[1-1. Alloy Preparation Step]

The alloy preparation step is a step of preparing an alloy which is a solid solution containing α-Fe as a solvent and at least one type of α-phase stabilizing element as a solute. In other words, an alloy prepared in the alloy preparation step contains α-Fe and at least one type of α-phase stabilizing element. The alloy preparation step involves preparing the alloy by, for example, gas atomization or ball milling.

α-Fe is a main component of the alloy, and has a thermal conductivity of about 67 W/m·K at room temperature. Note that the phase of Fe for use in preparation of the alloy is not limited, provided that Fe in the alloy is α-Fe.

An α-phase stabilizing element is an element that suppresses phase transformation of α-Fe to γ-Fe in the austenitic temperature range. Examples of the α-phase stabilizing element include beryllium (Be), aluminum (Al), phosphorus (P), silicon (Si), zinc (Zn), tin (Sn), antimony (Sb), chromium (Cr), molybdenum (Mo), tungsten (W), niobium (Nb), tantalum (Ta), vanadium (V), titanium (Ti), and the like. Out of those listed above, Ti, Nb, V, and Ta are preferred for their ability to stabilize the α phase of Fe even when added only in a small amount. Note that the alloy may contain only one type of α-phase stabilizing element or may contain two or more types of α-phase stabilizing elements.

The α-phase stabilizing element is preferably a carbide-forming element which reacts with carbon to precipitate as a carbide. The precipitation of the α-phase stabilizing element as a carbide makes it possible to improve the hardness of the α-Fe—SiC composite. Examples of the carbide-forming element include Ti, Nb, V, and Ta, which are preferred for their ability to stabilize the α phase of Fe even when added only in a small amount.

[1-2. First Mixing Step]

The first mixing step is a step of preparing a mixture of at least one type of α-phase stabilizing element in powder form and SiC (such a mixture is hereinafter referred to as "first mixture"). The first mixture thus contains at least one type of α-phase stabilizing element and SiC.

The α-phase stabilizing element used here may be the same type of element as or a different type of element from the α-phase stabilizing element(s) used in the alloy preparation step. In the first mixing step, two or more types of α-phase stabilizing elements may be used in combination, similarly to the alloy preparation step.

SiC has a hardness of about 2200 HV, and has a thermal conductivity of about 270 W/m·K at room temperature. When a material containing SiC is used to make a mold, the mold will have improved hardness and improved thermal conductivity.

The first mixing step involves mixing SiC and α-phase stabilizing element(s) to disperse particles of the α-phase stabilizing element(s) on the surface of the SiC in a substantially uniform manner. A method and apparatus for use in the first mixing step are not particularly limited, provided that the method and apparatus are capable of dispersing particles of the α-phase stabilizing element(s) on the surface of the SiC in a substantially uniform manner. For example, an apparatus such as a ball mill (e.g., V-type mixer, planetary ball mill) can be used to prepare a first mixture.

[1-3. Second Mixing Step]

The second mixing step is a step of preparing a mixture of the alloy prepared in the alloy preparation step and the first mixture obtained through mixing in the first mixing step (such a mixture prepared in the second mixing step is hereinafter referred to as "second mixture").

A method and apparatus for use in the second mixing step are not particularly limited, provided that the method and apparatus are capable of mixing the alloy prepared in the alloy preparation step and the first mixture. For example, an apparatus such as a ball mill (e.g., V-type mixer, planetary ball mill) can be used. The second mixture can also be prepared by carrying out mixing with use of a ball mill under wet conditions in which an auxiliary agent such as ethanol is used. When the mixing is carried out under wet conditions, crushing of SiC is prevented or reduced, making it possible to prevent or reduce a reduction in thermal conductivity of the finally obtained Fe—SiC composite which would otherwise result from interfacial thermal resistance.

Figure 1:
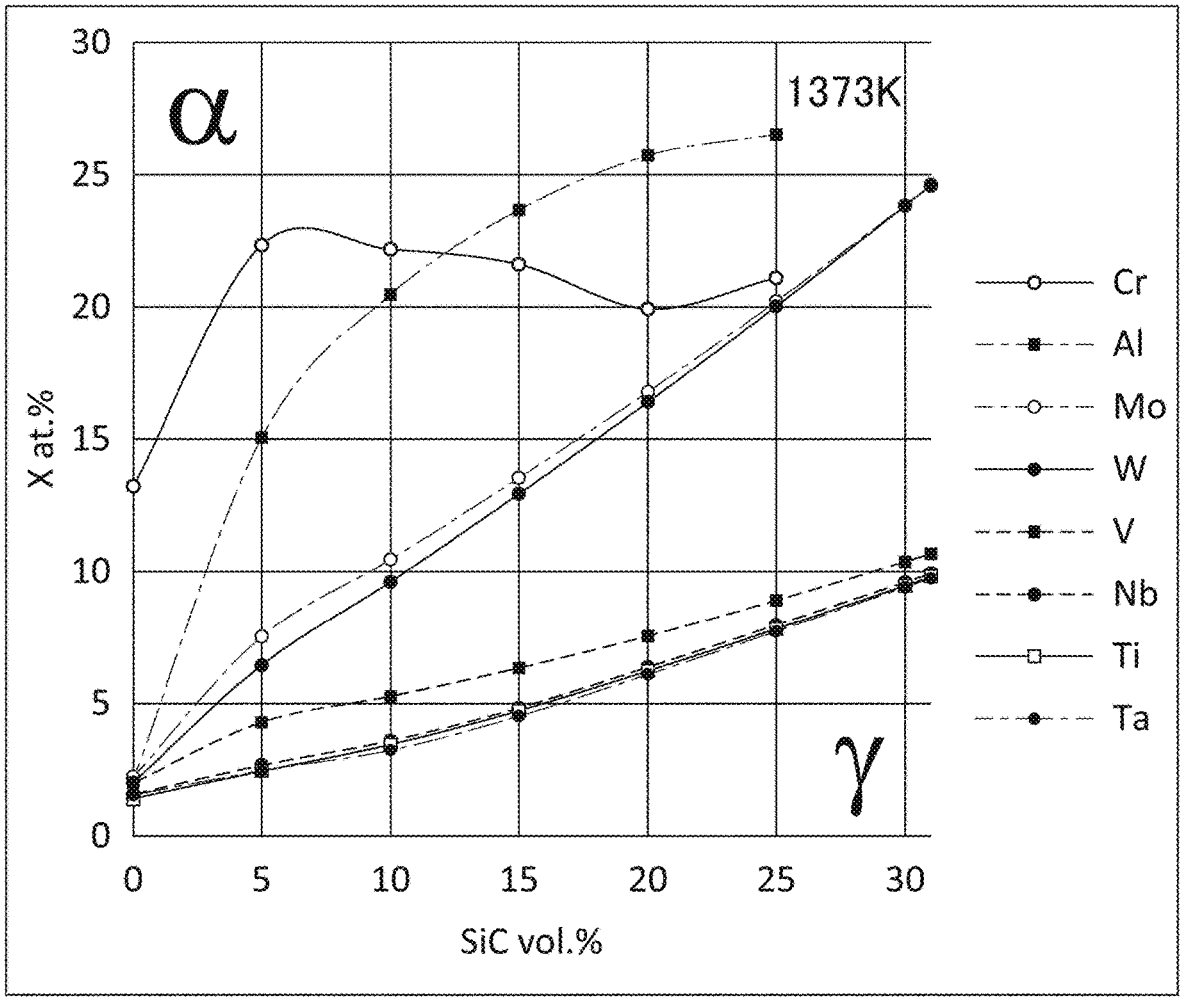
FIG. 1 is a chart showing the minimum amount of each type of α-phase stabilizing element necessary for Fe to be α-Fe versus the amount of decomposed SiC at 1373 K.

In the second mixing step, it is preferable that the second mixture be prepared such that the second mixture contains the α-phase stabilizing element(s) in an amount necessary for Fe contained in the second mixture to be fully α-Fe. Such an amount can be determined by calculation. Examples of the calculated necessary amounts of α-phase stabilizing elements are shown in FIG. 1. FIG. 1 is a chart showing the minimum amount of each type of α-phase stabilizing element necessary for Fe to be fully α-Fe versus the amount of decomposed SiC at 1373 K. The chart was prepared using JMatPro (manufactured by Sente Software). As shown in FIG. 1, for example, in a case where the amount of decomposed SiC is 15 vol. % (at the point "15 vol. %" on the horizontal axis of the chart) and in a case of an alloy containing not less than 5 at. % of Ti relative to Fe of the α-Fe—SiC composite (at the point "5 at. %" or higher on the vertical axis of the chart), Fe is fully in α-phase at 1373 K.

Specifically, for example, in a case where Ti and Nb are used as α-phase stabilizing elements, it is preferable that the α-phase stabilizing elements be contained in an amount of not less than 5.0 at. % relative to Fe in the α-Fe—SiC composite.

A second mixture that contains α-phase stabilizing element(s) in an amount necessary for Fe contained in the second mixture to be fully α-Fe can be obtained by appropriately adjusting the amount of α-phase stabilizing element (s) added during the alloy preparation step and the amount of α-phase stabilizing element(s) added during the first mixing step.

Preparing a second mixture such that the second mixture contains α-phase stabilizing element(s) in an amount necessary for Fe contained in the second mixture to be fully α-Fe makes it possible to prevent Fe from undergoing phase transformation to γ-Fe during the sintering step (described later). Note that, for obtaining a Fe—SiC composite having high thermal conductivity, it is preferable that the amount of the α-phase stabilizing element(s) be as small as possible.

In a case where ball milling is used in the second mixing step, particles of the α-phase stabilizing element(s) are distributed on the Fe—SiC interface in a non-uniform manner, as compared to the case where, for example, the alloy is prepared by gas atomization. This makes it possible to suppress the decomposition of SiC during the sintering step (described later).

[1-4. Sintering Step]

The sintering step is a step of sintering the second mixture obtained from the second mixing step. The sintering step is carried out to obtain an α-Fe—SiC composite in accordance with Embodiment 1.

It is noted here that γ-Fe has a longer interatomic distance than α-Fe and therefore atoms and vacancies in γ-Fe move more easily than α-Fe. Therefore, when SiC (silicon carbide) is added to γ-Fe, Si atoms contained in the SiC are likely to be diffused in the γ-Fe. Furthermore, γ-Fe has larger lattice spacing than α-Fe. Therefore, when SiC is added to γ-Fe, C atoms contained in the SiC are likely to enter the α-Fe. That is, C atoms contained in the SiC are likely to be diffused. For these reasons, in a case where SiC is contained in γ-Fe, the SiC is more likely to decompose in the austenitic temperature range than in the case where the SiC is contained in α-Fe.

In Embodiment 1, the second mixture contains α-phase stabilizing element(s). This makes it possible, in the sintering step, to suppress phase transformation from α-Fe to γ-Fe. This makes it possible to suppress the decomposition of SiC in Fe.

In Embodiment 1, sintering in the sintering step is carried out by spark plasma sintering. Note, however, that the method of sintering in the present invention is not limited to spark plasma sintering, and some other sintering method (e.g., electric current sintering, hot pressing, hot isostatic pressing (HIP), or the like) can be used to carry out sintering.

The spark plasma sintering uses electrical discharge, and is therefore capable of removing an oxide film resulting from base powder. Furthermore, the sintering by spark plasma sintering takes less time to complete than conventional sintering methods. The spark plasma sintering therefore makes it possible to suppress the decomposition of SiC.

In the sintering step of Embodiment 1, the spark plasma sintering is carried out at a temperature not lower than 1273 K. Furthermore, in the sintering step of Embodiment 1, it is preferable that, once a temperature has been raised to the highest temperature, the temperature be not maintained at the highest temperature and the heating be stopped. This makes it possible to further suppress the decomposition of SiC.

<2. α-Fe—Sic Composite>

The α-Fe—SiC composite prepared by the foregoing method contains (i) an alloy which is a solid solution containing α-Fe as a solvent and at least one type of α-phase stabilizing element as a solute and (ii) SiC. Furthermore, in the α-Fe—SiC composite in accordance with Embodiment 1, the proportion by volume of the SiC to the alloy is not less than 1.0%, and the average particle size of the SiC is 1 μm to 100 μm. This makes it possible to form heat conduction pathways (i.e., pathways through which heat is conducted with high efficiency in the α-Fe—SiC composite), and also possible to improve the strength and thermal conductivity due to the SiC. That is, it is possible to obtain a composite having high strength and high thermal conductivity.

Note that, when the particle size of SiC is not more than 100 μm, dispersion strengthening occurs, making it possible to improve the hardness of a composite. When the particle size of SiC is not less than 1 μm, it is possible to prevent or reduce a reduction in thermal conductivity of the composite that would otherwise result from interfacial thermal resistance. With regard to preventing or reducing a reduction in thermal conductivity of the composite that would result from interfacial thermal resistance, a preferred particle size can be determined by theoretical calculation using, for example, Equation (9) disclosed in "Effect of the Interfacial Thermal Resistance on the Effective Thermal Conductivity of Aluminum Matrix Composites, J. Japan Inst. Met. Master. Vol. 81, No. 10 (2017), pp. 467-474". According to the result of the theoretical calculation using the above equation, a reduction in thermal conductivity can be prevented or reduced, provided that the particle size of SiC is not less than about 208 nm; however, the particle size of SiC may be not less than 1 μm, in consideration of usability such as aggregation of particles. Note that the average particle size of SiC can be determined from an image such as an SEM image or an EPMA image.

With regard to the α-Fe—SiC composite in accordance with Embodiment 1, there is no particular limitation on the upper limit of the proportion by volume of the SiC to the alloy. However, assuming that SiC particles are spheres, 74% of the closest packed structure is occupied by the SiC; therefore, the volume of the SiC may be not more than 74%. On the other hand, the lower limit of the proportion by volume of the SiC to the alloy is set to 1.0%, because even only a small amount of SiC particles contained in a composite is expected to result in improvements in hardness and thermal conductivity.

When the average particle size of the SiC is not less than 1 μm, it is possible to prevent or reduce a reduction in thermal conductivity that would otherwise result from interfacial thermal resistance. Furthermore, when the average particle size of the SiC is not more than 100 μm, it is possible to achieve good mixing. Note that the average particle size can be determined from an image such as an SEM image or an EPMA image.

Embodiment 2

The following description will discuss another embodiment of the present invention.

<3. Method of Producing α-Fe—SiC Composite>

A method of producing an α-Fe—SiC composite in accordance with Embodiment 2 includes an alloy preparation step, a third mixing step, a fourth mixing step, and a sintering step. Note that the alloy preparation step is the same as that described earlier in Embodiment 1, and therefore its descriptions are omitted here.

[3-1. Third Mixing Step]

The third mixing step is a step of preparing a mixture of the alloy prepared in the alloy preparation step and at least one type of α-phase stabilizing element in powder form (such a mixture prepared in the third mixing step is hereinafter referred to as "third mixture"). A method and apparatus for use in the third mixing step are not particularly limited, provided that the method and apparatus are capable of mixing the alloy prepared in the alloy preparation step and at least one type of α-phase stabilizing element in powder form. For example, an apparatus such as a ball mill (e.g., V-type mixer, planetary ball mill) can be used.

In the third mixing step, it is preferable that the third mixture be prepared such that the third mixture contains the α-phase stabilizing element(s) in an amount necessary for Fe contained in the third mixture to be fully α-Fe, for the same reason as described in Embodiment 1. Specifically, for example, in a case where Ti and Nb are used as α-phase stabilizing elements, it is preferable that the α-phase stabilizing elements be contained in an amount of not less than 5.0 at. % relative to Fe in the α-Fe—SiC composite.

A third mixture that contains α-phase stabilizing element (s) in an amount necessary for Fe contained in the third mixture to be fully α-Fe can be obtained by appropriately adjusting the amount of α-phase stabilizing element(s) added during the alloy preparation step and the amount of α-phase stabilizing element(s) added during the third mixing step.

[3-2. Fourth Mixing Step]

The fourth mixing step is a step of preparing a mixture of the third mixture and SiC (such a mixture prepared in the fourth mixing step is hereinafter referred to as "fourth mixture"). A method and apparatus for use in the fourth mixing step are not particularly limited, provided that the method and apparatus are capable of mixing the third mixture and SiC. For example, an apparatus such as a ball mill (e.g., V-type mixer, planetary ball mill) can be used.

The fourth mixture can also be prepared by carrying out mixing with use of a ball mill under wet conditions in which an auxiliary agent such as ethanol is used. When the mixing is carried out under wet conditions, crushing of SiC is prevented or reduced, making it possible to prevent or reduce a reduction in thermal conductivity of the finally obtained Fe—SiC composite which would otherwise result from interfacial thermal resistance.

In a case where ball milling is used in the fourth mixing step, particles of the α-phase stabilizing element(s) are distributed on the Fe—SiC interface in a non-uniform manner, as compared to the case where, for example, the alloy is prepared by gas atomization. This makes it possible to suppress the decomposition of SiC during the sintering step.

<4. α-Fe—Sic Composite>

The α-Fe—SiC composite prepared by the foregoing method contains (i) an alloy which is a solid solution containing α-Fe as a solvent and at least one type of α-phase stabilizing element as a solute and (ii) SiC, as with the α-Fe—SiC composite of Embodiment 1. Furthermore, in the α-Fe—SiC composite in accordance with Embodiment 2, the proportion by volume of the SiC to the alloy is not less than 1.0%, and the average particle size of the SiC is 1 μm to 100 μm. This makes it possible to form heat conduction pathways, and also possible to improve the hardness and thermal conductivity due to the SiC. That is, it is possible to obtain a composite having high strength and high thermal conductivity.

EXAMPLES

The following description will discuss Examples of an α-Fe—SiC composite of the present invention and Comparative Examples of an α-Fe—SiC composite. (a) and (b) of FIG. 2 are SEM images of alloys prepared in the alloy preparation step. (a) and (b) of FIG. 3 are charts showing particle size distribution of the alloys. In Examples, α-Fe—SiC composites in accordance with Examples 1 to 3 as Examples of an α-Fe—SiC composite, and α-Fe—SiC composites in accordance with Comparative Examples 1 to 7 as Examples of an α-Fe—SiC composite, were prepared. The amounts of α-phase stabilizing element(s) and SiC added and conditions under which sintering was carried out, for each of Examples 1 to 3 and Comparative Examples 1 to 7, are shown in Table 1.

TABLE 1

| | Production method | Amount of α-phase stabilizing element(s) added (at. %) | Amount of SiC added (vol. %) | Sintering temperature (K) | Time for which temperature was maintained (min.) |
|---|---|---|---|---|---|
| Ex. 1 | 1 | 16.0 | 40 | 1373 | 0 |
| Ex. 2 | 2 | 20.0 | 30 | 1373 | 0 |
| Ex. 3 | 2 | 15.0 | 40 | 1373 | 0 |
| Com. Ex. 1 | 3 | 2.0 | 20 | 1373 | 0 |
| Com. Ex. 2 | 4 | 3.0 | 30 | 1373 | 0 |
| Com. Ex. 3 | 4 | 7.0 | 30 | 1373 | 0 |
| Com. Ex. 4 | 4 | 39.7 | 50 | 1373 | 0 |
| Com. Ex. 5 | 5 | 12.0 | 30 | 1373 | 0 |
| Com. Ex. 6 | 5 | 12.0 | 30 | 1273 | 10 |
| Com. Ex. 7 | 5 | 12.0 | 30 | 1273 | 20 |

Note:
Ex. stands for Example, Com. Ex. stands for Comparative Example.

Example 1

Example 1 was prepared by the following production method 1. The production method 1 is the production method described in Embodiment 1.

[Production Method 1]

<1-1. Alloy Preparation Step>

Ti and Nb were used as α-phase stabilizing elements, and gas atomization was used to prepare an alloy in powder form. The alloy was prepared so that the alloy would contain Ti in an amount of 4 at. % and Nb in an amount of 8 at. %, relative to Fe contained in the alloy. An SEM image and particle size distribution of the prepared alloy are shown in (b) of FIG. 2 and (b) of FIG. 3, respectively. Note that the gas atomization was carried out at a temperature of 1823 K.

<1-2. First Mixing Step>

In the first mixing step, Ti in an amount of 4 at. % relative to Fe contained in the alloy, and SiC in an amount of 40% relative to the volume of the alloy for use in a second mixing step (described later), were mixed with use of a V-type mixer to prepare a first mixture. In the first mixing step, the mixing was carried out with use of an aluminum container and alumina balls. The alumina balls, having a mass ten times the combined masses of the materials subjected to mixing (SiC and Ti), were added, and the mixing was carried out under dry conditions at 50 rpm for 6 hours.

<1-3. Second Mixing Step>

The first mixture and the alloy prepared in the alloy preparation step were mixed with use of a V-type mixer to prepare a second mixture. Note that, in the same manner as the first mixing step, alumina balls were added to the V-type mixer, and the mixing was carried out under wet conditions at 50 rpm for 3 hours. In the second mixing step, ethanol as an auxiliary agent was added so that the materials subjected to the mixing were covered, and then the mixing was carried out.

<1-4. Sintering Step>

In the sintering step, the second mixture obtained from the second mixing step was molded, and then pre-sintered by spark plasma sintering at 15 MPa and 500 K for 15 minutes. After the pre-sintering, final sintering was carried out by spark plasma sintering at 50 MPa and 1373 K without maintaining the temperature. In this way, an α-Fe—SiC composite of Example 1 was obtained.

Example 2

Example 2 was prepared by the following production method 2. The production method 2 is the production method described in Embodiment 2.

[Production Method 2]

The alloy preparation step and the sintering step were carried out in the same manner as described in Example 1.

<2-1. Third Mixing Step>

The alloy prepared in the alloy preparation step of the foregoing Example 1, and Ti in an amount of 8 at. % relative to Fe contained in the alloy, were mixed with use of a planetary ball mill to prepare a third mixture. The mixing was carried out under the same conditions as the first mixing step of Example 1, except that the mixing was carried out for 3 hours.

<2.2. Fourth Mixing Step>

The third mixture prepared in the third mixing step, and SiC in an amount of 30% relative to the volume of the third mixture, were mixed with use of a V-type mixer to prepare a fourth mixture. The mixing was carried out under the same conditions as the second mixing step of Example 1.

Example 3

An α-Fe—SiC composite of Example 3 was prepared in the same manner as the α-Fe—SiC composite of Example 2, except for the following points (A) and (B). (A) In the alloy preparation step, Ti was used as an α-phase stabilizing element, and gas atomization was used to prepare an alloy in powder form. The alloy was prepared so that the alloy would contain Ti in an amount of 2 at. % relative to Fe contained in the alloy. An SEM image and particle size distribution of the prepared alloy are shown in (a) of FIG. 2 and (a) of FIG. 3, respectively.

(B) In the third mixing step, the amount of Ti added was 13 at. % relative to Fe contained in the alloy.

Comparative Example 1

Comparative Example 1 was prepared by the following production method 3.

[Production Method 3]

Comparative Example 1 was prepared by: mixing the alloy prepared in the alloy preparation step of Example 3 and SiC under the same conditions as the second mixing step of Example 1 to obtain a mixture; and sintering the mixture. Note that the SiC was mixed in an amount of 20% relative to the volume of the alloy. The sintering was carried out under the same conditions as the sintering step of Example 1.

Comparative Example 2

Comparative Example 2 was prepared by the following production method 4.

[Production Method 4]

Comparative Example 2 was prepared by: mixing the alloy prepared in the alloy preparation step of Example 3, Ti, and SiC under the same conditions as the second mixing step of Example 1 to obtain a mixture; and sintering the mixture. Note that the Ti was mixed so that the Ti was 3 at. % relative to Fe contained in the alloy, and the SiC was mixed in an amount of 30% relative to the volume of the alloy. The sintering was carried out under the same conditions as the sintering step of Example 1.

Comparative Example 3

Comparative Example 3 was prepared in the same manner as described in Comparative Example 2, except that Ti was mixed so that the Ti was 7 at. % relative to Fe contained in the alloy.

Comparative Example 4

Comparative Example 4 was prepared in the same manner as described in Comparative Example 3, except that Ti was mixed so that the Ti was 39.7 at. % relative to Fe contained in the alloy.

Comparative Example 5

Comparative Example 5 was prepared by the following production method 5.

[Production Method 5]

Comparative Example 5 was prepared by: mixing the alloy prepared in the alloy preparation step of Example 1 and SiC under the same conditions as the second mixing step of Example 1 to obtain a mixture; and sintering the mixture. Note that the SiC was mixed in an amount of 30% relative to the volume of the alloy. The sintering was carried out under the same conditions as the sintering step of Example 1.

Comparative Example 6

Comparative Example 6 was prepared in the same manner as described in Comparative Example 5, except for the conditions under which sintering was carried out. In Comparative Example 6, the sintering was carried out at 1273 K which was maintained for 10 minutes.

Comparative Example 7

Comparative Example 7 was prepared in the same manner as described in Comparative Example 5, except for the conditions under which sintering was carried out. In Comparative Example 7, the sintering was carried out at 1273 K which was maintained for 20 minutes.

<Evaluation Method>

The prepared α-Fe—SiC composites were evaluated on the basis of relative density determined by the Archimedes method, steady-state heat conduction measurement, Vickers hardness test, area fraction of SiC, and the like.

The relative density was measured with use of LA120S manufactured by Sartorius.

The steady-state heat conduction measurement was carried out with use of a data collection/switch unit (34970A manufactured by Agilent).

The Vickers hardness test was carried out with use of a Vickers hardness tester (FV-810 manufactured by Future-Tech).

The area fraction of SiC refers to the percentage of SiC remaining in the prepared α-Fe—SiC composite to the added SiC, and was determined using the expression (area fraction of SiC of α-Fe—SiC composite/(amount of SiC added)). Note that the area fraction of SiC of the α-Fe—SiC composite was determined from an optical micrograph or the like.

<Results>

The results of evaluation carried out by the above evaluation methods are shown in Table 2.

TABLE 2

| | Production method | Relative density (%) | Thermal conductivity (W/m · K) | Vickers hardness (HV) | Area fraction (%) |
|---|---|---|---|---|---|
| Ex. 1 | 1 | 104.3 | 46.5 | 604 | 11.7 |
| Ex. 2 | 2 | 98.1 | 24.5 | 626 | 15.3 |
| Ex. 3 | 2 | 97.6 | 35.2 | 698 | 24.5 |
| Com. Ex. 1 | 3 | 100.6 | 35.8 | 347 | 0 |
| Com. Ex. 2 | 4 | 99.8 | 40 | 510 | 0 |
| Com. Ex. 3 | 4 | 98.6 | 39.8 | 405 | 4.34 |
| Com. Ex. 4 | 4 | 87.7 | 27 | 355 | 32.8 |
| Com. Ex. 5 | 5 | 97.6 | 34.2 | 452 | 9.43 |
| Com. Ex. 6 | 5 | 88.5 | 29.0 | 316 | 14.9 |
| Com. Ex. 7 | 5 | 97.4 | 36.4 | 448 | 0.66 |

Note:
Ex. stands for Example, Com. Ex. stands for Comparative Example.

In each of the α-Fe—SiC composites of Examples 1 to 3, the decomposition of SiC was suppressed. As a result, the α-Fe—SiC composites had a thermal conductivity of not less than about 24 W/m·K and a Vickers hardness of not less than 600 HV, and were excellent in hardness and thermal conductivity.

Comparative Examples 1 to 7 were each inferior to Examples 1 to 3 in terms of Vickers hardness. Note that, in Comparative Example 4, the decomposition of SiC was suppressed because the α-phase stabilizing element was added in an amount of about 40% relative to Fe contained in the α-Fe—SiC composite; however, Comparative Example 4 was inferior in Vickers hardness.

In the production method 2 (Examples 2 and 3), the α-phase stabilizing elements were added by gas atomization and powder mixing. On the contrary, in the production method 5 (Comparative Examples 5 to 7), the α-phase stabilizing elements in amounts substantially the same as those of the α-phase stabilizing elements added during the production method 2 were added only by gas atomization. As a result of evaluation of the effects of a method of adding α-phase stabilizing element(s) on the percentage of remaining SiC, it was confirmed that powder mixing is also preferably carried out (see FIG. 4). It is inferred that the powder mixing resulted in localization of the α-phase stabilizing element at the interface between α-Fe and SiC, and resulted in suppression of the decomposition of SiC.

In Comparative Example 4 and Comparative Example 6, the decomposition of SiC was suppressed, but relative density was low. That is, Comparative Example 4 and Comparative Example 6 contained a lot of vacancies. As a result, Comparative Example 4 and Comparative Example 6 had low hardness. Furthermore, since Comparative Example 4 and Comparative Example 6 have low relative density, Comparative Example 4 and Comparative Example 6 are expected to have low tensile strength and low fatigue characteristics.

Furthermore, Comparative Example 6 and Comparative Example 7 were different from Comparative Example 5 in terms of the conditions under which sintering was carried out. For the α-Fe—SiC composite to receive substantially the same quantity of heat over the period of sintering, the sintering temperature was maintained for a certain period of time, instead of lowering the sintering temperature. In Comparative Example 6, the temperature was lowered by 100 K (lowered to 1273K) and maintained for 10 minutes. In Comparative Example 7, the same temperature as Comparative Example 6 was maintained for 20 minutes. As shown in FIG. 5, the decomposition of SiC was accelerated when the temperature was maintained for a long time. The relative density also decreased, because of the low sintering temperature. This demonstrates that it is possible to suppress the decomposition of SiC and thus possible to prepare a sample having high relative density (i.e., high hardness) by carrying out sintering in a short time, as compared to lowering the sintering temperature.

The invention claimed is:

1. A method of producing an α-Fe—SiC composite, comprising:

an alloy preparation step comprising preparing an alloy which is a solid solution containing α-Fe as a solvent and at least one type of α-phase stabilizing element as a solute;

a first mixing step comprising mixing at least one type of α-phase stabilizing element in powder form and SiC to prepare a first mixture;

a second mixing step comprising mixing the alloy and the first mixture to prepare a second mixture, the second mixture prepared in the second mixing step containing the at least one type of α-phase stabilizing element in an amount of not less than 15.0 at. % and not more than 20 at. % relative to Fe contained in the α-Fe—SiC composite, the second mixture containing, as at least part of the at least one type of α-phase stabilizing element, Ti in an amount of not less than 8.0 at. % relative to Fe contained in the α-Fe—SiC composite; and a sintering step comprising sintering the second mixture.

2. The method as set forth in claim 1, wherein the at least one type of α-phase stabilizing element is a carbide-forming element.

3. The method as set forth in claim 2, wherein the carbide-forming element is at least one selected from the group consisting of Ti, Nb, V, and Ta.

4. The method as set forth in claim 1, wherein, in the sintering step, sintering is carried out by spark plasma sintering.

5. The method as set forth in claim 4, wherein, during the spark plasma sintering, heating is stopped once a set sintering temperature has been reached, without maintaining the second mixture or the fourth mixture at the set sintering temperature.

6. The method as set forth in claim 1, wherein in the second mixing step, the alloy and the first mixture are mixed with use of a ball mill.

7. The method as set forth in claim 1, wherein the at least one type of α-phase stabilizing element is Ti and at least one kind selected from the group consisting of Nb, V, and Ta.

* * * * *